United States Patent [19]

Ruch et al.

[11] Patent Number: 5,005,817

[45] Date of Patent: Apr. 9, 1991

[54] SHEET FEEDING MECHANISM AND METHOD FOR AN ELECTROPHOTOGRAPHIC PRINTER

[75] Inventors: Mark H. Ruch; Roger Q. Paulsel; Patricia J. Naron, all of Houston, Tex.

[73] Assignee: Compaq Computer Corporation, Houston, Tex.

[21] Appl. No.: 360,395

[22] Filed: Jun. 2, 1989

[51] Int. Cl.[5] ..... B65H 3/44

[52] U.S. Cl. ..... 271/9; 271/117; 271/164

[58] Field of Search ..... 271/9, 117, 118, 164

[56] References Cited

FOREIGN PATENT DOCUMENTS

| | | | |
|---|---|---|---|
| 0040339 | 3/1985 | Japan | 271/9 |
| 0040356 | 3/1985 | Japan | 271/9 |
| 0167834 | 8/1985 | Japan | 271/117 |
| 0171943 | 9/1985 | Japan | 271/9 |
| 0171945 | 9/1985 | Japan | 271/117 |
| 0197541 | 10/1985 | Japan | 271/9 |

*Primary Examiner*—H. Grant Skaggs

*Attorney, Agent, or Firm*—J. David Cabello; James R. Burdett

[57] ABSTRACT

A paper handling apparatus 10 for an electrophotographic printer and, in particular, a desktop laser printer includes a series of paper containing trays 12, 14, 16, 18, which are configured to receive a variety of different styles and sizes of sheets of paper. The trays 12, 14, 16, 18 are individually horizontally arranged and collectively configured in a vertically stacked arrangement. A single paper feeding mechanism 20 is configured for selective operation with each of the vertically stacked trays 12, 14, 16, 18 by employing a rolamite to provide controlled vertical movement of the paper feeding mechanism 20 adjacent the vertically stacked trays 12, 14, 16, 18. The trays 12, 14, 16, 18 are selectively horizontally moveable so as to intersect the vertical path of the paper feeding mechanism, so as to allow the single paper feeding mechanism 20 to selectively engage one of the plurality of trays 12, 14, 16, 18 and sequentially remove individual sheets of paper from the selected tray 12, 14, 16, 18.

25 Claims, 4 Drawing Sheets

SHEET FEEDING MECHANISM AND METHOD FOR AN ELECTROPHOTOGRAPHIC PRINTER

BACKGROUND OF THE INVENTION

1. Field of the Invention

This invention relates generally to a method and apparatus for selectively feeding sheets of paper from a plurality of stacks of paper to a printer and, more particularly, a single apparatus for selectively engaging multiple stacks of paper and feeding single sheets from the selected stack of paper to a printer.

2. Description of the Related Art

In the field of printers and, in particular, electrophotographic printers, such as desktop laser printers, paper handling mechanisms typically employ a separate sheet feeding mechanism for each tray of paper that the laser printer has the ability to access. These trays typically are configured to hold approximately 250 sheets of paper and include a bottom portion that supports the stack of paper and is hinged to allow the stack of paper to be pivoted upward and against the stationary sheet feeding mechanism associated with that tray. Pressure is maintained between the sheet feeding mechanism and the stacks of paper by a spring acting against the hinged bottom portion.

Therefore, when the laser printer includes a paper handling mechanism that has more than one tray, each tray ordinarily has a dedicated sheet feeding mechanism associated therewith. These pairs of trays and sheet feeding mechanisms are normally stacked in a vertical arrangement and consume vertical space equal to the height of the 250 sheet tray and the vertical height of each sheet feeding mechanism. Accordingly, the vertical height of each tray and sheet feeding mechanism limits the maximum number of trays that can be associated with a paper handling mechanism of a laser printer. Combining more than a preselected number of trays and sheet feeding mechanisms simply produces a paper handling mechanism that is too large for a desktop environment.

Further, it should also be appreciated that the pressure between the sheet feeding mechanism and the stack of paper varies with the thickness of the stack of paper remaining in the tray. That is to say, the force applied by a spring is nonlinear since it is dependent upon the degree of compression of the spring. As the height of the stack of paper changes, the compression of the spring necessarily varies therewith, and the force applied by the nonlinear spring must also similarly vary.

Moreover, since the sheet feeding mechanism is stationary and the spring force applied to the stack of paper in its associated tray is accomplished by a spring located in the paper handling mechanism, the paper is constantly maintained in contact with the sheet feeding mechanism. Thus, when additional paper is loaded into a particular tray, the printing process from that tray must cease while the tray is removed and the paper supply replenished. This is particularly important where the user wishes to print a short run of unique paper that differs from the paper currently located in the tray.

To overcome this inherent deficiency, previous laser printers have employed a single sheet feeding mechanism whereby an operator desiring to print a small number of copies on a paper style unique from that currently loaded in the trays may singularly and consecutively feed the number of sheets required for the printing process. This, of course, is a time intensive process that does not free the user to accomplish other tasks, but requires that the user remain at the printer, consecutively feeding each sheet of paper until the entire printing process is completed.

Alternatively, the user may remove the tray from the paper handling mechanism, insert the desired number of sheets of paper into the tray and replace the tray into the paper handling mechanism. While this method does free the user to leave the area of the printer during the printing process, the procedure of removing the tray and loading the tray with a precise, preselected number of unique sheets of paper is also a laborious and time intensive task.

Additionally, the market for desktop laser printers is highly competitive and, therefore, extremely cost sensitive. Accordingly, it is desirable that any proposed solution to these above-identified problems be economical, durable, and simple in design, construction, and repair.

The present invention is directed to overcoming one or more of the problems as set forth above.

SUMMARY OF THE INVENTION

The primary object of the present invention is to provide a paper handling mechanism for a printer that is simple in construction and operation, compact in size, and capable of handling a large capacity and variety of types of paper.

Another object of the present invention is to provide a paper handling mechanism for a printer that supplies a substantially constant pressure between the paper picker and the stack of paper.

Yet another object of the present invention is to provide a paper handling mechanism for a printer that is readily loaded with limited supplies of unique paper to allow the printer to access unique paper styles for short runs.

Still another object of the present invention is to provide a paper handling mechanism that includes a series of vertically stacked trays, which are manually and automatically horizontally movable to a readily accessible loading position.

To attain these and other objectives, a paper handling apparatus for a printer is provided. The apparatus includes a paper feeding means for contacting a selected one of a plurality of stacks of sheets of paper and removing a selected one of the sheets of paper from the selected stack of sheets of paper. The paper feeding means is controllably moveable along a preselected substantially vertical path. Additionally, a plurality of paper receiving trays are each adapted for receiving a stack of sheets of paper and are generally vertically arranged relative to one another. Each of the trays is adapted for general horizontal movement between a first selected position and a second unselected position, where the first selected position intersects the substantially vertical path of the paper feeding means.

In another aspect of the present invention, a method is provided for controlling a paper handling apparatus for an electrophotographic printer. The paper handling apparatus includes a paper feeding mechanism moveable along a preselected vertical path and a plurality of trays, where each tray is adapted for receiving a stack of sheets of paper. The method includes the steps of selecting one of the plurality of trays in response to receiving a print request for that tray and moving the selected tray from a first position to a second position, wherein the second position intersects the vertical path of the paper feeding mechanism. Further, the paper feeding mechanism is moved downward along the preselected vertical path into contact with the stack of paper located in the selected tray. Finally, the paper feeding mechanism consecutively removes sheets of paper from the selected tray.

BRIEF DESCRIPTION OF THE DRAWINGS

Other objects and advantages of the invention will become apparent upon reading the following detailed description and upon reference to the drawings in which.

Figure 1:
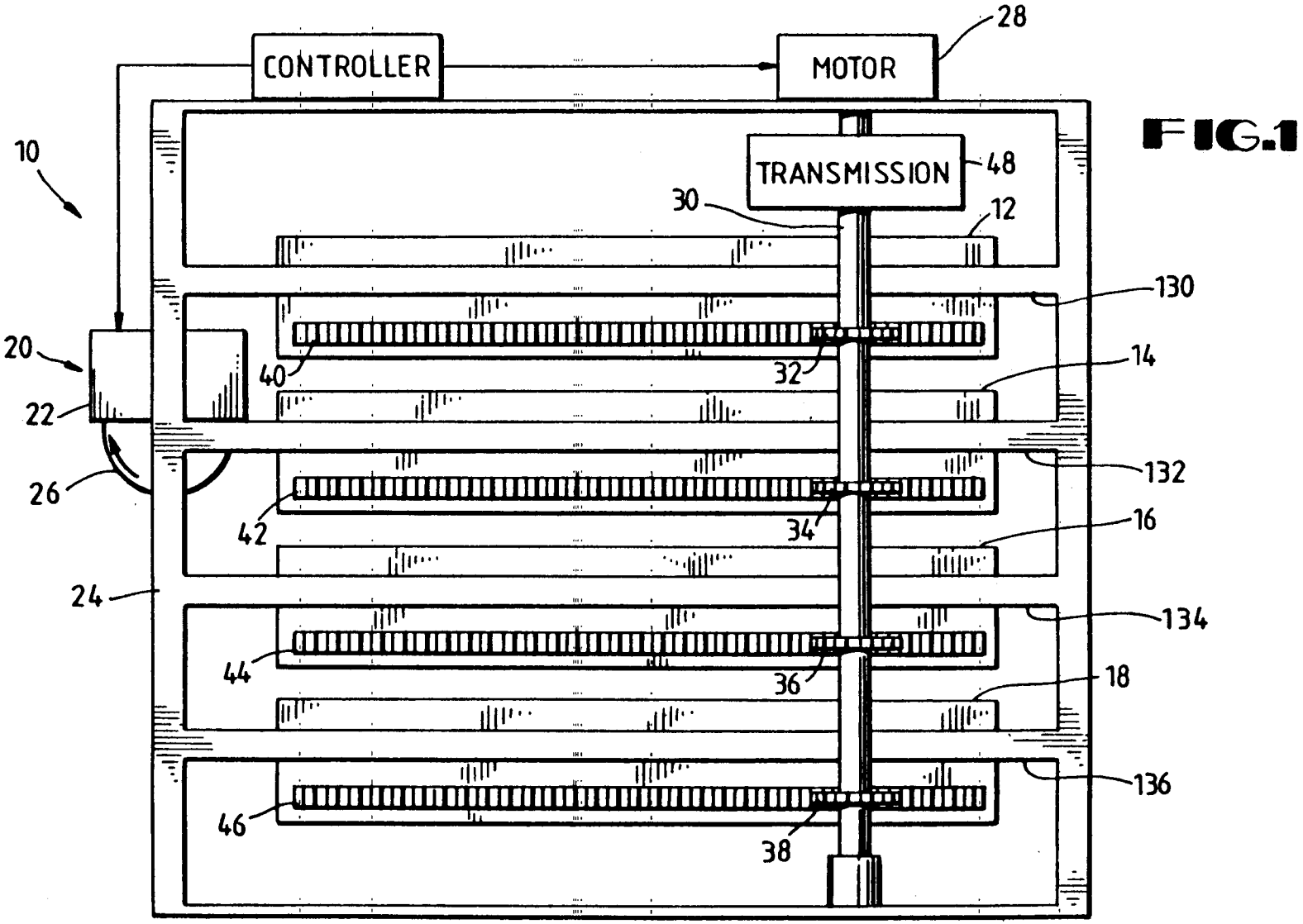
FIG. 1 is a conceptual schematic of the paper handling apparatus.

While the invention is susceptible to various modifications and alternative forms, specific embodiments thereof have been shown by way of example in the drawings and are herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Turning to the drawings and referring first to FIG. 1, a side view of a conceptual schematic of a paper handling apparatus 10 for a printer (not shown) is shown. While the discussion of the apparatus 10 herein is confined to being combined with an electrophotographic printer, it is readily envisioned that the apparatus 10 may be combined with various types and styles of printers without departing from the spirit and scope of the instant invention.

The apparatus 10 includes a series of paper containing trays 12, 14, 16, 18, which are configured to receive a variety of different styles and sizes of sheets of paper. Preferably, each tray 12, 14, 16, 18 contains a different style of paper so that a user of the electrophotographic printer simply designates which tray to use in order to select the proper style of paper. For example, it is desirable to load each of the trays 12, 14, 16, 18 respectively with letterhead, white bond, yellow bond, A4, legal, etc. Thus, the user is relieved of the time consuming task of loading the printer with additional paper each time a different style of paper is desired.

To conserve space and reduce the overall cost of the paper handling apparatus 10, the trays 12, 14, 16, 18 are arranged vertically in close proximity to one another with a single paper feeding mechanism 20 provided to operate with all of the trays 12, 14, 16, 18, 20. The paper feeding mechanism 20 moves vertically to selectively engage one of the plurality of trays 12, 14, 16, 18. This vertical movement is effected by an electric motor 22 that is connected to and possibly travels with the paper feeding mechanism 20 along a vertical frame assembly 24. The vertical frame assembly 24 is constructed from a variety of devices, including a rack and pinion and a rolamite; however, the rolomite version is preferred and is discussed in greater detail herein.

It should be noted that the motor 22 also provides power to a rotating rubber wheel 26 that contacts the stacks of paper located in each of the trays. Contact between the rotating wheel 26 and the top sheet in any of the stacks of paper urges the top sheet from the stack into the electrophotographic printer, where the actual printing process is performed.

The paper feeding mechanism 20 is generally limited to vertical movement. The trays 12, 14, 16, 18 are also vertically arranged. Therefore, for the paper feeding mechanism 20 to contact a selected one of the stacks of paper, the trays 12 14, 16, 18 are preferably horizontally moveable between the first selected position and the second unselected position where the tray intersects the vertical path of the paper feeding mechanism 20.

A single electric motor 28 provides the mechanical power to selectively drive the trays 12, 14, 16, 18 between these first and second positions. The motor 28 is connected to a shaft 30, which extends vertically along one side of the trays 12, 14, 16, 18. A plurality of gears 32, 34, 36, 38 are fixed to the shaft 30 at various vertical locations to respectively coincide with racks 40, 42, 44, 46 extending horizontally along the side of each of the trays 12, 14, 16, 18.

Thus, rotation of the motor 28 in a first direction produces similar rotation in the shaft 30 and the gears 32, 34, 36, 38. The gears 32, 34, 36, 38 interact with their corresponding rack 40, 42, 44, 46 and convert the rotational movement into horizontal linear movement of each of the trays 12, 14, 16, 18. It should be clear that rotation of the motor 28 in a first direction produces horizontal movement of the trays 12, 14, 16, 18 from the first to the second position, while rotation of the motor 28 in a second direction moves the trays 12, 14, 16, 18 from the second to the first position.

However, it should be appreciated that in order for the paper feeding mechanism 20 to properly intersect with the trays 12, 14, 16, 18, the selected tray is preferably horizontally moved between the unselected and selected position without corresponding movement of the unselected trays. For example, if the user desires to print on paper contained in the lowest tray 18, then not only must it move to the selected position, but the unselected trays must also remain in the unselected position. Otherwise, the trays 12, 14, 16 interfere with vertical movement of the paper feeding mechanism 20 and prevent the paper feeding mechanism 20 from descending to and contacting the paper contained in the lowest tray 18. It should be appreciated that similar problems arise when operation of intermediate trays 12, 14 is desired.

Accordingly, the motor 28 and shaft 30 employ a transmission 48 to selectively engage only one of the desired gears 32, 34, 36, 38. One embodiment of such a transmission 48 is discussed in a copending patent application by Mark H. Ruch et al, filed June 2, 1989 as application number 360,437, subject to an assignment to the assignee of the instant application.

Figure 2:
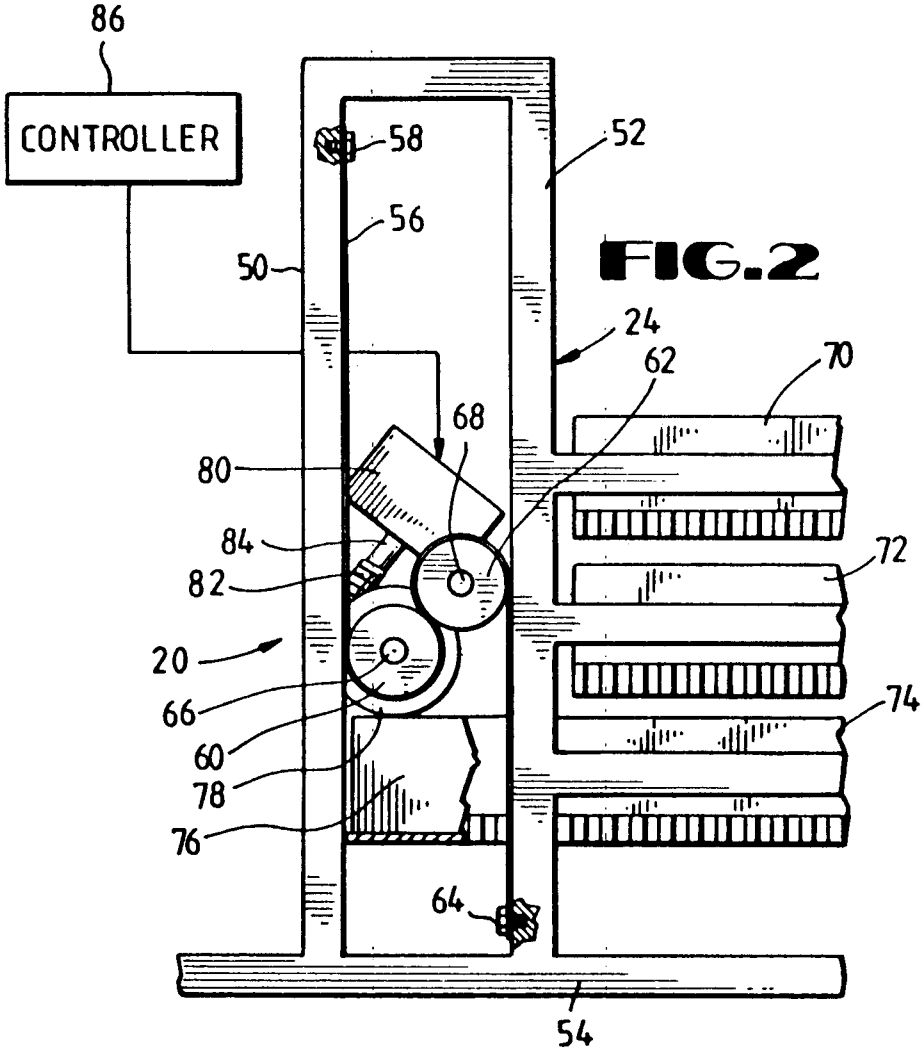
FIG. 2 is a side view of one embodiment of the instant apparatus.

Referring to FIG. 2, a side view of the rolamite version of the paper feeding mechanism 20 and the frame assembly 24 is shown. The vertical frame assembly 24 includes a pair of rails 50, 52 extending generally vertically from a base 54 and spaced a preselected substantially constant distance apart. A strip of spring steel 56 is attached to an upper interior surface of the rail 50 by a screw 58, extends downward along the interior surface and around the lower circumference of a first roller 60, returns upward over the upper circumference of a second roller 62, and extends downward along the interior surface of the rail 52 where it is connected to the interior surface of the rail 52 by a screw 64.

With the arrangement shown in FIG. 2, rotation of the lower roller 60 in the clockwise and counterclockwise directions correspondingly produces downward and upward movement of the rollers 60, 62. Operation of the rollers 60, 62 is discussed more fully in connection with the description of FIG. 3.

The rollers 60, 62 each have a shaft 66, 68 respectively passing coaxially therethrough and extending through a second pair of rollers 60', 62' respectively (see FIG. 4), which are captured between a substantially identical pair of rails and strip of spring steel positioned a sufficient distance away to allow paper trays 70, 72, 74 to be disposed therebetween. The trays 70, 72, 74 are generally vertically arranged, but have the capability of being selectively horizontally driven between the selected and unselected positions.

For example, the trays 70, 72 are illustrated in the unselected position, while the lowest tray 74 is shown in the selected position. That is to say, the lowest tray 74 has been driven horizontally forward to intersect the vertical path of the paper feeding mechanism 20. The paper feeding mechanism 20 is shown contacting the top sheet of a stack of paper 76 contained in the paper tray 74.

In particular, a rubber wheel 78 is concentrically disposed about the shaft 66 between the roller 60 and its matching parallel roller. The rubber wheel 78 is selected to have a sufficiently high durometer to insure substantial friction between the wheel 78 and the top sheet of paper in the stack 76. In this manner, rotation of the rubber wheel 78 in a clockwise direction urges the top sheet of paper from the stack of paper 76 and generally to the left in the diagram of FIG. 2. It should be understood that a paper receiving mechanism (not shown) of an electrophotographic printer (not shown) is positioned to the left of the paper handling mechanism 20 and is adapted for receiving the sheet of paper displaced to the left by rotation of the rubber wheel 78.

Rotation of both the rubber wheel 78 and the rollers 60, 62 is provided by an electric motor 80 connected to the shaft 68. The motor 80 is any of a variety of standard types of electric motors, but preferably is a stepper motor with a worm 82 connected to its rotating output shaft 84. The worm 82 interacts with a standard worm gear 96 (see FIG. 4) concentrically positioned about the shaft 66 and adapted to translate the rotational movement of the shaft 84 into rotational movement of the rubber wheel 78 and rollers 60, 62.

Operation of the motor 80 is effected by a controller 86 that is preferably microprocessor based, but can also be any of a variety of hardwired controllers. A more detailed description of the functional operation of the controller 86 is disclosed in conjunction with the flowchart representation illustrated in FIG. 7.

Figure 3:
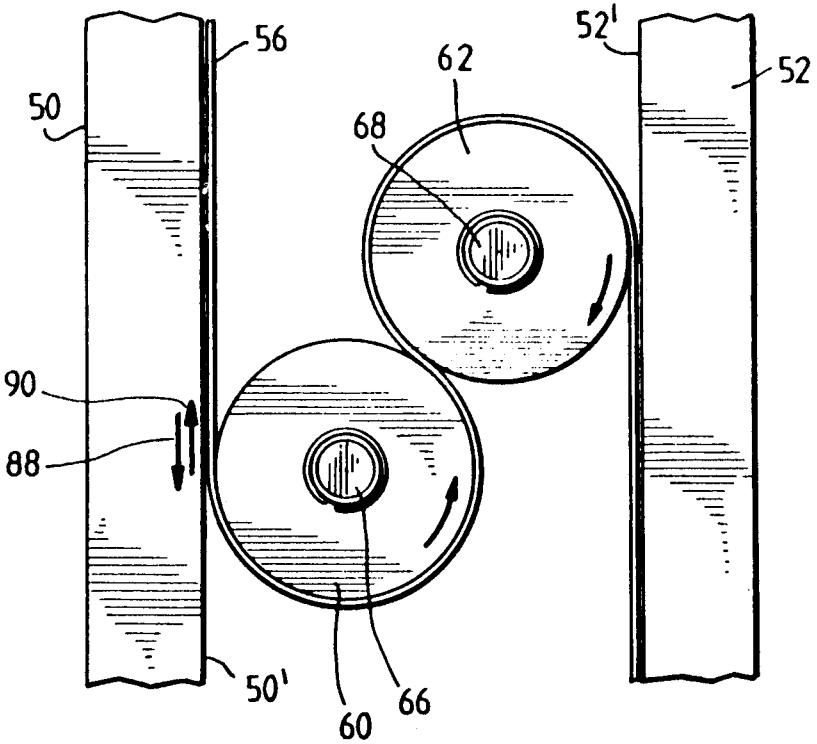
FIG. 3 is a detailed side view of a rolamite used for controlling vertical motion of the paper feeding mechanism.

Referring to FIG. 3, operation of the rolamite is described in greater detail. To the extent possible, elements illustrated in FIG. 3 that are common to FIG. 2 are assigned common element numbers to enhance the identity of elements and to aid in the understanding of the operation of the rolamite.

The rails 50, 52 are spaced a preselected distance apart, which is relatively insignificant except that the diameters of the rollers 60, 62 are preferably substantially similar and each must be greater than one-half the preselected distance between the interior surfaces of the rails 50, 52. Otherwise, the upper roller 62 would be unsupported and free to fall downward. The spring steel 56 extending around the lower circumference of the lower roller 60 supports that roller, while the upper roller 62 is captured between the lower roller 66 and the rail 52.

Operation of the rolamite rollers 60, 62 is more easily comprehended if the rollers 60, 62 are analogized to the wheels of an automobile and the spring steel 56 is viewed as the road surface on which the automobile travels. Consider, for example, vertically upward movement of the rollers 60, 62. The roller 60 is rotated in the counterclockwise direction, producing a force tangential to the roller surface and parallel to the surface of the rail 50 (represented by arrow 88). Assuming that this tangential force is sufficient to overcome any forces in the opposite direction (i.e. gravity, friction, etc.), then the roller 60 moves vertically upwardly along the spring steel 56, much like the tire of an automobile moving along the road surface.

Alternatively, the strip of spring steel 56, relative to the roller 60, can be considered to be moving counterclockwise around the circumference of the roller 60. Therefore, the strip of spring steel 56 must also be moving clockwise around the upper roller 62. Thus, by configuring the upper roller 62 to be an idler that is not driven by the motor 80 but is allowed to be rotated in the clockwise direction by movement of the spring steel 56, the pair of rollers 60, 62 moves upwardly in response to the motor 80 driving the lower roller 60 in the counterclockwise direction.

Consider now, for example, vertically downward movement of the rollers 60, 62. The roller 60 is rotated in the clockwise direction, producing a force tangential to the roller surface and parallel to the surface of the rail 50 (represented by arrow 90). Assuming that this tangential force along with the force exerted by gravity is sufficient to overcome any forces in the opposite direction (i.e. friction, etc.), then the roller 60 moves vertically downwardly along the spring steel 56, much like the tire of an automobile moving along the road surface.

Alternatively, the strip of spring steel 56, relative to the roller 60, can be considered to be moving clockwise around the circumference of the roller 60. Therefore, the strip of spring steel 56 must also be moving counterclockwise around the upper roller 62. Thus, by configuring the upper roller 62 to be an idler that is not driven by the motor 80, but is allowed to be rotated in the counterclockwise direction by movement of the spring steel 56, the pair of rollers 60, 62 moves downwardly in response to the motor 80 driving the lower roller 60 in the clockwise direction.

It should be appreciated that, ordinarily, the weight of the rollers 60, 62 is sufficient to induce rotation of the rollers 60, 62 in the clockwise and counterclockwise directions, respectively. This, of course, results in downward movement of the rollers 60, 62. Thus, absent some device to prevent unrestricted rotation of the rollers 60, 62, they are predisposed to movement to the lowest possible vertical position. Therefore, the motor 80 is preferably a stepper motor, which resists rotation unless specifically commanded to rotate by the controller 86. That is to say, the stepper motor 80 acts to maintain its rotational position unless specifically commanded to alter its rotational position. The mechanical connection between the motor 80 and the lower roller 60 insures that the lower roller 60 is not free to rotate in an uncontrolled manner in the clockwise direction.

Figure 4:
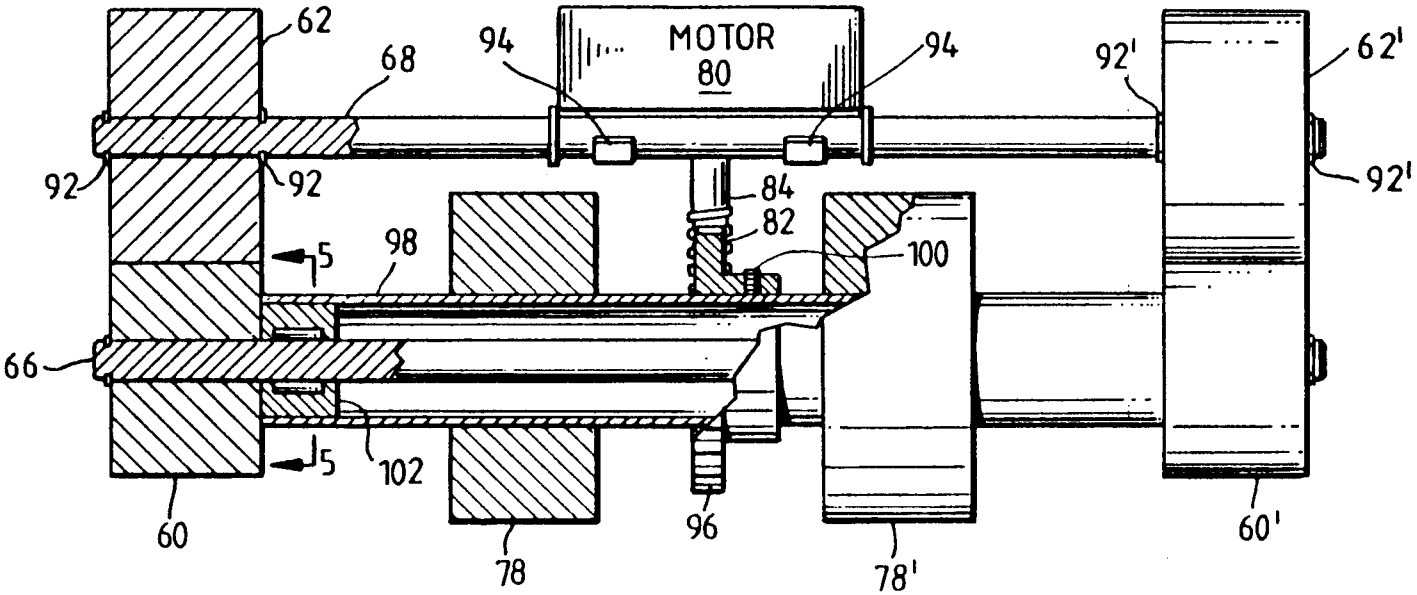
FIG. 4 is a detailed end view, shown partially in cross section, of a rolamite and one-way clutch for controlling vertical movement of the paper feeding mechanism.

Referring to FIG. 4, the paper feeding mechanism 20 is shown in a partial cross-sectional end view. The upper roller 62 and its opposite twin 62' are illustrated coaxially located on the shaft 68. The bores 90, 90' extending through the rollers 62, 62' are slightly larger than the diameter of the shaft 68. Thus, the rollers are located on the shaft and maintained in that location by pairs of snap rings 92, 92'.

In this manner, the rollers 62, 62' are free to rotate relative to the shaft 68. This feature is significant considering that the motor 80 is attached to the shaft 68 by a pair of clamps 94 extending over the shaft 68 and bolted to the motor 80. Preferably, the shaft 68 does not rotate, but, as described in conjunction with FIG. 3, it is desirable that the rollers 62, 62' are free to rotate.

The lower roller 60 and its opposite twin 60' are illustrated coaxially located on the shaft 66. Unlike the rollers 62, 62', the rollers 60, 60' are fixed to the shaft 66 to prevent any relative rotation therebetween. Preferably, the rollers 60, 60' are press fitted onto the shaft 66. The purpose of this connection is to ensure a positive mechanical link between the motor 80 and the rollers 60, 60' to prevent uncontrolled downward movement of the rollers 60, 60', as discussed in conjunction with FIG. 3.

The worm 82 of the motor 80 is indirectly coupled to the rollers 60, 60' via the standard worm gear 96 that is positively connected to a tube 98 extending coaxially about the shaft 66 between the rollers 60, 60'. The gear 96 is coupled to the tube 98 by, for example, a set screw 100.

The rubber wheel 78, which is shown to preferably include a pair of rubber wheels 78, 78', is also connected to the exterior of the tube 98. The connection is, however, less positive, relying only on friction between the rubber wheels 78, 78' and the exterior surface of the tube 98. In this manner, the rubber wheels 78, 78' are free to be longitudinally oriented to apply an even pressure to the particular size paper loaded in the selected tray 70, 72, 74. Alternatively, the rubber wheels 78, 78' are adapted to be fixedly located on the tube 98 at multiple locations. This configuration accommodates paper of various sizes.

The tube 98 is coaxially supported about the shaft 66 by a pair of one-way clutches 102 located adjacent each end of the tube 98 near the rollers 60, 60'. The one-way clutches 102 are configured to provide relative rotational movement between the tube 98 and shaft 66 in one rotational direction, but not in the other rotational direction. Preferably, when the tube 98 is rotated by the motor 80 in the counterclockwise direction (as described in FIG. 3) to provide for upward linear movement of the rollers 60, 62, the one-way clutches 102 drive the shaft 66 and roller 60, 60'. This, of course produces upward linear movement of the paper feeding mechanism 20.

Conversely, when the tube 98 is rotated by the motor 80 in the clockwise direction (as described in FIG. 3) so as to provide for downward linear movement of the rollers 60, 62, the one-way clutches 102 do not drive the shaft 66 and roller 60, 60', but rather, allow the weight of the paper feeding mechanism 20 to induce rotation and downward movement of the rollers 60, 62.

In this manner, the tube 98 and rubber wheels 78, 78' are free to continue rotating even after they contact the top sheet of paper in the selected tray 70, 72, 74. The one-way clutches 102, however, prevent the rotation of the tube 98 from continuing to drive the rollers 60, 60' once the desired vertical height is reached. It should be noted that the paper feeding mechanism 20 is still free to move further downward as paper is consumed but is not forced to do so by rotation of the tube 98 and wheels 78, 78'.

Thus, the force exerted between the wheels 78, 78' and the selected stack of paper is independent of the height of the stack of paper, and depends merely upon the weight of the paper feeding mechanism 20, which is constant. This is in contrast to prior art devices that have a spring force that urges the stack of paper against the paper feeding mechanism. Clearly, as the height of the stack of paper changes, the force applied by even a linear spring also changes.

Therefore, it should be appreciated that rotation of the motor 80 in a first direction permits the rollers 60, 60' to rotate and controllably move linearly downwardly, while rotation of the motor 80 in a second direction forces the rollers 60, 60' to rotate and controllably move linearly upwardly. Also, because of the one-way clutches 102, the motor 80 provides the power that both moves the paper feeding mechanism 20 vertically, and rotates the rubber wheels 78, 78' to feed individual sheets of paper into the electrophotographic printer.

Figure 5:
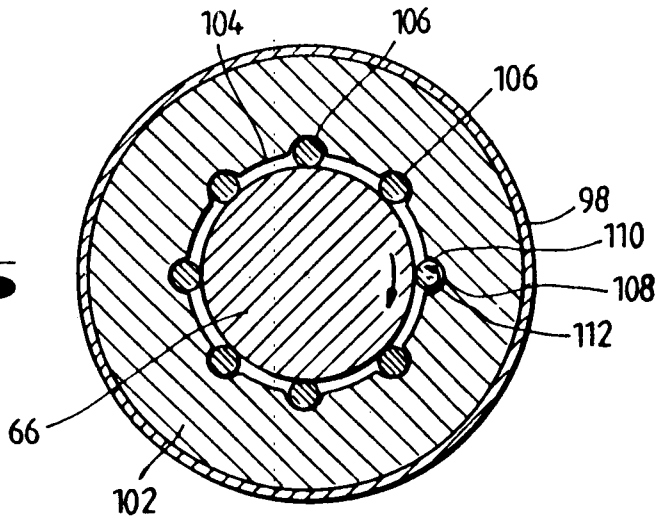
FIG. 5 is a cross-sectional view of the one-way clutch.

Referring now to FIG. 5, a cross-sectional view of the one-way clutch 102, tube 98, and shaft 66 is illustrated to more fully describe the operation of the one-way clutch 102. The one-way clutch 102 is a commercially available device available from Winfred M. Berg, Inc. located at 499 Ocean Av., East Rockaway, N.Y. 11518 as part number NRC-4.

The one-way clutch 102 is disposed within the tube 98 and fixedly connected thereto. Preferably, the one-way clutch 102 is press fitted into the tube 98; however, other methods of fixing the clutch 102 within the tube 98 are contemplated that do not depart from the spirit and scope of the invention described herein. For example, the clutch 102 can be fixed to the tube 98 by gluing, welding, brazing, soldering, threading, or various other mechanical or chemical methods.

The one-way clutch 102 includes a central bore 104 extending coaxially therethrough in general alignment with the tube bore. The central bore 104 receives the shaft 66 and supports the shaft 66 via a series of cylindrical roller bearings 106 uniformly disposed about the periphery of the bore 104.

To provide the one-way clutching action, the roller bearings 106 are contained within nonsymmetrical chambers 108. The chambers 108 are divided into first and second longitudinal halves 110, 112. The first longitudinal half 110 has an arcuate cross-sectional configuration with a radius substantially similar to the radius of the roller bearings 106, while the second longitudinal half 112 is tapered in a direction extending away from the roller bearing 108.

In this manner, when the shaft 66 rotates in a counterclockwise direction, the roller bearing 108 is forced to rotate in the clockwise direction by the contact therebetween. Also, the roller bearing 108 is forced against the matching arcuate surface of the first longitudinal half 110. Thus, the roller bearing is free to rotate, thereby permitting the shaft 66 to also rotate in the counterclockwise direction.

On the other hand, when the shaft 66 rotates in a clockwise direction, the roller bearing 108 is forced to attempt to rotate in the counterclockwise direction by the contact therebetween. Also, the roller bearing 108 is forced against the tapered surface of the second longitudinal half 112. The roller bearing 108 is, of course, "pinched" by the tapered surface and thereby prevented from rotating in the counterclockwise direction. Thus, since the roller bearing 108 cannot rotate in the counterclockwise direction, then the shaft 66 is similarly prevented from rotating in the clockwise direction.

It should be appreciated that the direction of the one-way clutch 102 is readily reversible by simply inserting the clutch 102 into the tube 98 in the opposite longitudinal direction. Thus, the shaft 66 is then free for clockwise rotation, but prevented from counterclockwise rotation.

Figure 6:
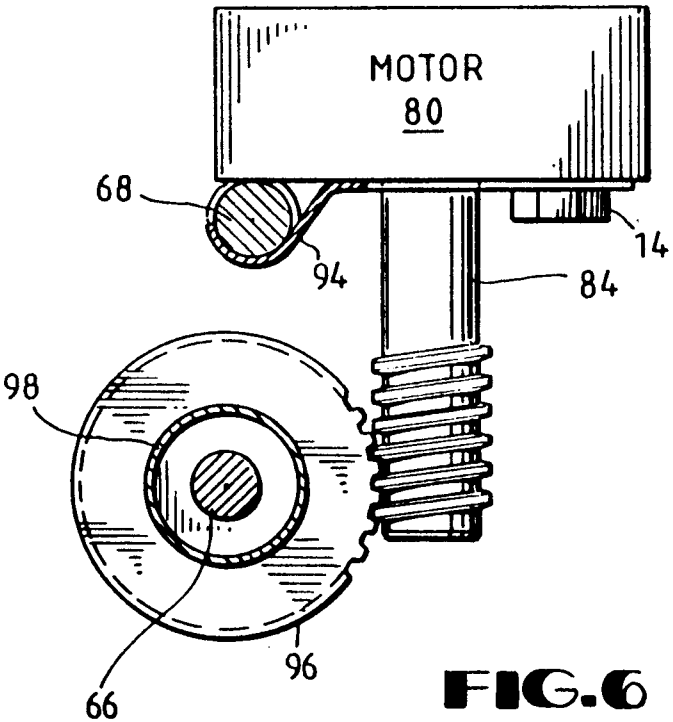
FIG. 6 is a side view of a stepper motor and worm gear used to drive the paper feeding mechanism.

Referring to FIG. 6, the mounting of the motor 80 relative to the shafts 66, 68 and the gear 96 is illustrated in greater detail. The bracket 94 extends arcuately over the shaft 68 and is attached to the motor housing 80 by a screw 114, thereby capturing the shaft 68 between the motor 80 and bracket 94.

The output shaft 84 of the motor 80 extends from the motor 80 generally tangentially toward the worm gear 96. The output shaft 84 includes a worm 82 formed thereon or attached thereto, which has a pitch that matches the tooth spacing of the gear 96. The worm 82 drivingly engages the teeth of the gear 96 and translates the rotation of the motor 80 into the orthogonal rotation of the tube 98.

It should be appreciated that in the illustrated embodiment, the worm 82 and worm gear 96 are not fixedly connected together, but remain meshed only through the weight of the motor 80. For example, the motor 80 is free for limited pivotal movement about the shaft 68. However, since the motor's center of gravity is closer to its centerpoint, which is clearly displaced to the right of the shaft 68, the motor has a tendency to pivot toward the gear 96 and remain engaged by virtue of a moment in the clockwise direction about the axis of the shaft 68. Other embodiments for connecting the motor to the tube 98 are envisioned, which do not rely on gravity alone.

Figure 7:
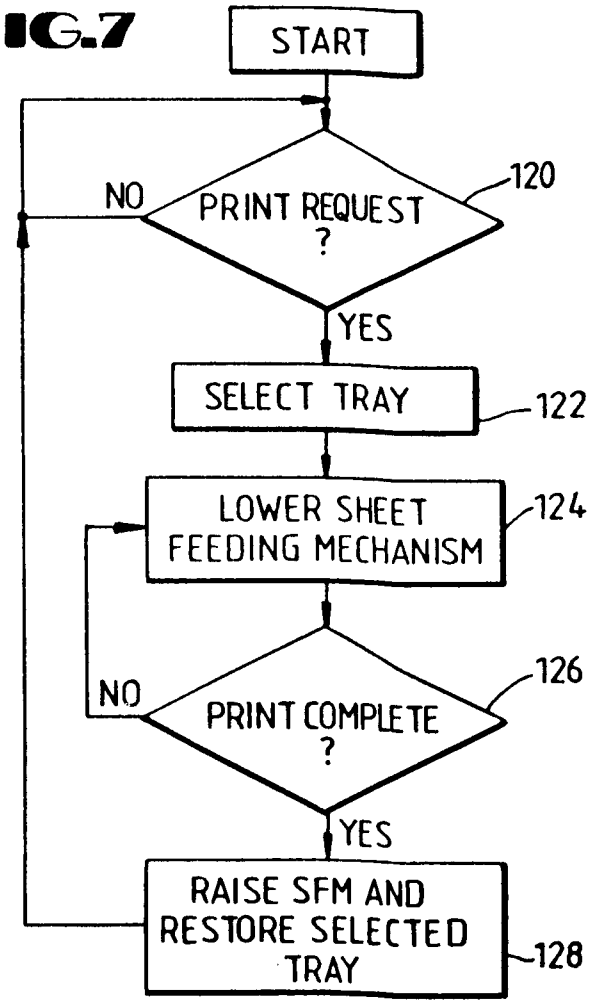
FIG. 7 is a flow chart representation of the control strategy implemented in the controller.

Referring to FIG. 7, a flow chart representation of the control strategy implemented in the controller 86 is illustrated. The process begins at decision block 120 where the controller 86 receives a request from the electrophotographic printer to provide a preselected number of sheets of paper from a selected one of the trays 70, 72, 74. The sheet feeding mechanism 20 has previously been raised to a sufficient vertical height to clear the trays 70, 72, 74, so that any one of the trays may be immediately moved from the unselected to the selected position.

The controller 86 responds to the request in block 122 by first moving the selected tray 70, 72, 74 to the selected position by energizing the motor 28 and actuating the transmission 48 to drive the selected tray into the vertical path of the sheet feeding mechanism 20.

In block 124, the controller 86 next energizes the motor 80 of the paper feeding mechanism 20 to produce rotation of the rollers 60, 62 and resultant downward motion of the paper feeding mechanism 20. The paper feeding mechanism 20 continues moving downwardly until the rubber wheels 78, 78' contact the selected stack of paper. Once the wheels 78, 78' contact the stack of paper, downward motion of the paper feeding mechanism substantially ceases, but the wheels 78, 78' continue to rotate, owing to the operation of the one-way clutches 102.

The motor 80 and wheels 78, 78' continue to rotate and deliver consecutive sheets of paper to the electrophotographic printer until the printer signals the controller 86 at decision block 126 that sufficient paper has been delivered and that the printing process is complete. Accordingly, upon receiving this signal from the printer, the controller 86 reverses the motor 80, which, because of the one-way clutches, rotates the rollers 60, 60' in their opposite direction, thereby causing the sheet feeding mechanism to move vertically upwardly and away from the selected tray 70, 72, 74 and its stack of paper.

Thereafter, in block 128 the controller restores the selected tray 70, 72, 74 to the unselected position by energizing the motor 28 in its opposite direction. At this point the printing process is substantially complete and the controller does nothing until the printer generates another print request, at which time the entire process is repeated.

It should be appreciated that when the printer is between print requests, all of the trays 70, 72, 74 are readily available for receiving paper. The added paper can either be additional paper of the same type, or small quantities of special paper specifically loaded for a special print request (i.e., transparencies for overheads, special size paper, special color paper, etc.). Loading the trays 70, 72, 74 is particularly simple because, unlike the prior devices, the paper feeding mechanism 20 is not in contact with the stack of paper. Thus, owing to a lack of mechanical obstructions, the paper is directly loadable into the trays 70, 72, 74 from the rear of the apparatus 10.

Moreover, referring again to FIG. 1, the motor 28 also drives the trays 12, 14, 16, 18 in the reverse direction to enhance user accessibility. A series of slides 130, 132, 134, 136, similar to furniture drawer slides, respectively support the trays 12, 14, 16, 18 and permit the trays to be fully extended to the right in FIG. 1.

Further, each of the trays 12, 14, 16, 18 are also manually movable to the right when the transmission 48 is not engaging the motor 28 with the respective racks 40, 42, 44, 46. The user is free to grasp each of the trays 12, 14, 16, 18 and slide them to the right, thereby exposing the top of the tray for easy loading of the desired paper.

An additional feature of the apparatus 10 involves the trays 12, 14, 16, 18 being user configurable. For example, in some instances it is desireable that rather than have four independently accessible trays 12, 14, 16, 18 that are each capable of holding, for example, five-hundred sheets of paper, that only a single tray be available that has a capacity of, for example, two-thousand sheets of paper.

The user readily adapts the apparatus 10 for such use by physically removing the upper trays 14, 16, 18 and then reprogramming the controller to indicate that only the single lower tray is available for use. Since the upper trays 14, 16, 18 are removed, paper is stacked into the lower tray 12 to a maximum height that permits the tray 12 and paper to move horizontally under the sheet feeding mechanism 20.

We claim:

1. A paper handling apparatus for an electrophotographic printer, comprising:

paper feeding means for contacting a selected one of a plurality of stacks of sheets of paper and removing a selected one of said sheets of paper from said selected stack of sheets of paper, said paper feeding means being controllably moveable along a preselected substantially vertical path; and a plurality of paper receiving trays, each of said trays being adapted for receiving a stack of sheets of paper, said plurality of trays being generally vertically arranged relative to one another and adapted for general horizontal movement between a first selected position and a second unselected position, wherein said first selected position intersects the substantially vertical path of said paper feeding means;

said paper feeding means including a single motor for both removing a selected one of said sheets of paper from said selected stack of sheets of paper and for moving said paper feeding means along the preselected substantially vertical path. second shaft being connected together through a one-way clutch.

2. An apparatus, as set forth in claim 1, wherein said paper feeding means is moveable between a first position contacting said selected stack of paper and a second position spaced from said stacks of paper, and said apparatus includes a controller for moving said paper feeding means from said second to said first position in response to receiving a print request signal and from said first position to said second position in response to receiving a print complete signal.

3. An apparatus, as set forth in claim 1, wherein said trays include a portion adapted for receiving sheets of paper so that said trays are free for loading in response to said sheet feeding means being in said second position.

4. An apparatus, as set forth in claim 1, wherein said trays include a portion adapted for receiving sheets of paper so that said unselected trays are free for loading independent of the sheet feeding means being in said first and second positions.

5. A paper handling apparatus for an electrophotographic printer, comprising:

paper feeding means for contacting a selected one of a plurality of stacks of sheets of paper and removing a selected one of said sheets of paper from said selected stack of sheets of paper, said paper feeding means being controllably moveable along a preselected substantially vertical path; and a plurality of paper receiving trays, each of said trays being adapted for receiving a stack of sheets of paper, said plurality of trays being generally vertically arranged relative to one another and adapted for general horizontal movement between a first selected position and a second unselected position, wherein said first selected position intersects the substantially vertical path of said paper feeding means;

said paper feeding means including a single motor for both removing a selected one of said sheets of paper from said selected stack of sheets of paper and for moving said paper feeding means along the preselected substantially vertical path and a rolamite connected to and driven by said motor whereby said motor moves said rolamite in first and second vertical directions in response to first and second directions of rotation of said motor.

6. An apparatus, as set forth in claim 5, wherein said rolamite includes first and second substantially vertical, facing rails spaced a preselected distance apart, a rectangular strip of spring steel connected to the upper interior surface of the first rail and to the lower interior surface of the second rail, and a first lower and upper roller positioned between said first and second rails and being respectively located with said spring steel extending from said first rail, around the lower circumference of said first lower roller, above the upper circumference of said first upper roller, and to the second rail, said first upper and lower rollers having a combined diameter greater than the preselected distance between said rails.

7. An apparatus, as set forth in claim 6, wherein said rolamite includes third and fourth vertical, facing rails spaced a preselected distance apart, a rectangular strip of spring steel connected to the upper interior surface of the third rail and to the lower interior surface of the fourth rail, and a second lower and upper roller positioned between said first and second rails and being respectively located with said spring steel extending from the third rail, around the lower circumference of said second lower roller, above the upper circumference of said second upper roller, and to the fourth rail, said second upper and lower rollers having a combined diameter greater than the preselected distance between said third and fourth rails.

8. An apparatus, as set forth in claim 7, wherein said first and second upper rollers include a bore extending coaxially therethrough and said rolamite includes a first shaft extending through said first and second upper roller bores, said first shaft being rotatably coupled to said first and second upper rollers whereby said first and second upper rollers are free to rotate relative to said first shaft.

9. An apparatus, as set forth in claim 8, wherein said first and second lower rollers include a bore extending coaxially therethrough and said rolamite includes a second shaft extending through said first and second lower roller bores, said second shaft being rotatably coupled to said first and second lower rollers whereby said first and second lower rollers are fixed against rotation relative to said second shaft, said motor being mounted on said first shaft and having a rotating output shaft coupled to said second shaft.

10. An apparatus, as set forth in claim 9, wherein said rotating output shaft is coupled to said second shaft through a clutching means for connecting the output shaft to the second shaft for rotation of the output shaft in a first direction and releasing the output shaft from the second shaft for rotation in a second direction.

11. An apparatus, as set forth in claim 10, wherein rotation of said motor in said first direction produces vertically upward movement of said rolamite and rotation of said motor in said second direction frees the rolamite for vertically downward movement.

12. An apparatus, as set forth in claim 11, wherein said motor is a stepper motor.

13. An apparatus, as set forth in claim 10, wherein said clutching means includes a one-way clutch disposed about the second shaft and connected to the output shaft.

14. An apparatus, as set forth in claim 10, wherein said clutching means includes a tube coaxially disposed about said second shaft between said first and second lower rollers and positively connected to the output shaft of said motor whereby rotation of said output shaft in a first and second direction rotates said tube in a first and second direction, said tube and second shaft being connected together through a one-way clutch.

15. An apparatus, as set forth in claim 14, wherein said paper feeding means includes at least one rubber wheel having a coaxial bore with said tube extending therethrough and a durometer sufficient to ensure substantial frictional contact between said wheel and the sheets of paper in said stacks of paper.

16. A paper handling apparatus for an electrophotographic printer, comprising:

paper feeding means for contacting a selected one of a plurality of stacks of sheets of paper and removing a selected one of said sheets of paper from said selected stack of sheets of paper, said paper feeding means being controllably moveable along a preselected substantially vertical path; and a plurality of paper receiving trays, each of said trays being adapted for receiving a stack of sheets of paper, said plurality of trays being generally vertically arranged relative to one another and adapted for general horizontal movement between a first selected position and a second unselected position, wherein said first selected position intersects the substantially vertical path of said paper feeding means;

said paper feeding means includes:

first and second substantially vertical, facing rails spaced a preselected distance apart, a rectangular strip of spring steel connected to the upper interior surface of the first rail and to the lower interior surface of the second rail, and a first lower and upper roller having a bore extending coaxially therethrough and being positioned between said first and second rails and respectively located with said spring steel extending from said first rail, around the lower circumference of said first lower roller, above the upper circumference of said first upper roller, and to the second rail, said first upper and lower rollers having a combined diameter greater than the preselected distance between said rails;

third and fourth substantially vertical, facing rails spaced a preselected distance apart, a rectangular strip of spring steel connected to the upper interior surface of the third rail and to the lower interior surface of the fourth rail, and a second lower and upper roller having a coaxial bore extending therethrough and being positioned between said third and fourth rails and respectively located with said spring steel extending from the third rail, around the lower circumference of said second lower roller, above the upper circumference of said second upper roller, and to the fourth rail, said second upper and lower rollers having a combined diameter greater than the preselected distance between said third and fourth rails;

a first shaft extending through said first and second upper roller bores, said first shaft being rotatably coupled to said first and second upper rollers whereby said first and second upper rollers are free to rotate relative to said first shaft;

a second shaft extending through said first and second lower roller bores, said second shaft being rotatably coupled to said first and second lower rollers whereby said first and second lower rollers are fixed against rotation relative to said second shaft; and a motor mounted on said first shaft and having a rotating output shaft coupled to said second shaft.

17. An apparatus, as set forth in claim 16, wherein said rotating output shaft is coupled to said second shaft through a clutching means for connecting the output shaft to the second shaft for rotation of the output shaft in a first direction and releasing the output shaft from the second shaft for rotation in a second direction.

18. An apparatus, as set forth in claim 17, wherein rotation of said motor in said first direction produces vertically upward movement of said paper feeding means and rotation of said motor in said second direction frees the paper feeding means for vertically downward movement.

19. An apparatus, as set forth in claim 18, wherein said motor is a stepper motor.

20. An apparatus, as set forth in claim 17, wherein said clutching means includes a one-way clutch disposed about the second shaft and connected to the output shaft.

21. An apparatus, as set forth in claim 17, wherein said clutching means includes a tube coaxially disposed about said second shaft between said first and second lower rollers and positively connected to the output shaft of said motor whereby rotation of said output shaft in a first and second direction rotates said tube in a first and second direction, said tube and second shaft being connected together through a one-way clutch.

22. An apparatus, as set forth in claim 21, wherein said paper feeding means includes at least one rubber wheel having a coaxial bore with said tube extending therethrough and a durometer sufficient to ensure substantial frictional contact between said wheel and the sheets of paper in said stacks of paper.

23. An apparatus, as set forth in claim 16, wherein said paper feeding means is moveable between a first position contacting said selected stack of paper and a second position spaced from said stacks of paper, and said apparatus includes a controller for moving said paper feeding means from said second to said first position in response to receiving a print request signal and from said first position to said second position in response to receiving a print complete signal.

24. An apparatus, as set forth in claim 16, wherein said trays include a portion adapted for receiving sheets of paper so that said trays are free for loading in response to said sheet feeding means being in said second position.

25. An apparatus, as set forth in claim 16, wherein said trays include a portion adapted for receiving sheets of paper so that said unselected trays are free for loading independent of the sheet feeding means being in said first and second positions.

* * * * *

UNITED STATES PATENT AND TRADEMARK OFFICE

CERTIFICATE OF CORRECTION

PATENT NO. : 5,005,817

DATED : April 9, 1991

INVENTOR(S) : Mark H. Ruch, Roger Q. Paulsel, Patricia J. Naron

It is certified that error appears in the above-identified patent and that said Letters Patent is hereby corrected as shown below:

Column 11, Line 28-30, after "preselected substantially vertical path." delete "second shaft being connected together through a one-way clutch."

Signed and Sealed this

Twenty-eighth Day of July, 1992

*Attest:*

DOUGLAS B. COMER

*Attesting Officer*

*Acting Commissioner of Patents and Trademarks*